US006382689B1

(12) United States Patent
Brown

(10) Patent No.: US 6,382,689 B1
(45) Date of Patent: May 7, 2002

(54) SECURITY DEVICE FOR A SLIDING DOOR OR WINDOW ASSEMBLY

(76) Inventor: Rodney James Brown, #102, 130-25th Avenue South West, Calgary, Alberta (CA), T2S 0K9

( * ) Notice: Subject to any disclaimer, the term of this patent is extended or adjusted under 35 U.S.C. 154(b) by 0 days.

(21) Appl. No.: 09/580,386

(22) Filed: May 26, 2000

(51) Int. Cl.[7] ..... E05C 17/44
(52) U.S. Cl. ..... 292/338; 292/274; 292/DIG. 46
(58) Field of Search ..... 292/262, 267, 292/274, 277, 259 R, 338, 339, DIG. 46

(56) References Cited

U.S. PATENT DOCUMENTS

| | | | | | |
|---|---|---|---|---|---|
| 837,595 | A | * | 12/1906 | Storr | 292/338 |
| 1,566,805 | A | * | 12/1925 | Ackerman | 292/338 |
| 1,602,226 | A | * | 10/1926 | Gully | 292/338 |
| 1,631,772 | A | * | 6/1927 | Shelton | 292/338 |
| 1,944,783 | A | * | 1/1934 | Ciriacy et al. | 292/334 |
| 2,704,220 | A | * | 3/1955 | Graham | 292/338 |
| 2,768,850 | A | * | 10/1956 | Minnis, Jr. | 292/338 |
| 3,328,920 | A | * | 7/1967 | Cohen et al. | 292/338 |
| 3,591,222 | A | | 7/1971 | Schaber et al. | |
| 4,017,105 | A | * | 4/1977 | Paxton | 292/338 |
| 4,073,522 | A | | 2/1978 | Tierney | |
| 4,461,502 | A | | 7/1984 | Burgess | |
| 4,483,558 | A | * | 11/1984 | Van Meter | 292/339 |
| 4,570,985 | A | | 2/1986 | Waldo et al. | |
| 4,631,776 | A | * | 12/1986 | King | 16/82 |
| 4,826,225 | A | * | 5/1989 | Styles | 292/338 |
| 5,040,835 | A | * | 8/1991 | Barker | 292/338 |
| 5,141,272 | A | * | 8/1992 | Veillette | 292/338 |
| 5,193,865 | A | | 3/1993 | Allenbaugh | |
| 5,203,596 | A | * | 4/1993 | Stevens | 292/204 |
| 5,282,658 | A | * | 2/1994 | Reeves, Jr. | 292/338 |
| 5,294,159 | A | * | 3/1994 | Corrigan | 292/258 |
| 5,432,461 | A | | 7/1995 | Andersen, III et al. | |

* cited by examiner

*Primary Examiner*—Paul N. Dickson
*Assistant Examiner*—Benjamin Pezzlo

(57) ABSTRACT

A security device for a sliding door or window assembly having a sliding panel in a frame. The device comprises a bar. A structure is for pivotally attaching a first end of the bar to an inner side edge of the panel. A fixed pin is secured longitudinally to a second end of the bar. The bar can pivot down one hundred and eighty degrees from an upright storage position to a downward locked position, allowing the fixed pin to engage with one of a plurality of spaced apart holes in a bottom track of the frame, thereby preventing the panel from being opened.

2 Claims, 2 Drawing Sheets

SECURITY DEVICE FOR A SLIDING DOOR OR WINDOW ASSEMBLY

BACKGROUND OF THE INVENTION

1. Field of the Invention.

The present invention relates generally to locking mechanisms. More particularly, the invention comprises a security device for a sliding door or window assembly.

In general, a first field of use of the disclosed invention is for businesses or homes as the most likely benefactors of the unique advantages of the instant invention. However, many other fields, such as for recreational vehicles or boats, could find potentially beneficial uses of this invention.

Thus, it can be seen that the potential fields of use for this invention are myriad and the particular preferred embodiments described herein is in no way meant to limit the use of the invention to the particular field chosen for exposition of the details of the invention.

A comprehensive listing of all the possible fields to which this invention may be applied is limited only by the imagination and is, therefore, not provided herein. Some of the more obvious applications are mentioned in the interest of providing a full and complete disclosure of the unique properties of this previously unknown general purpose article of manufacture. It is to be understood from the outset that the scope of this-invention is not limited to these fields or to the specific examples of potential uses presented herein.

2. Description of the Prior Art

Attempts have been made in the prior art to devise locking apparatuses for sliding doors and windows. Locking apparatuses are shown in U.S. Pat. No. 3,591,222, issued to Christian Schaber et al. on Jul. 6, 1971, U.S. Pat. No. 4,073,522, issued,to Timothy P. Tierney on Feb. 14, 1978, U.S. Pat. No. 4,461,502, issued to Rollie M. Burgess on Jul. 24, 1984, U.S. Pat. No. 4,570,985, issued to Russell W. Waldo et al. on Feb. 18, 1986, U.S. Pat. No. 5,193,865, issued to Howard M. Allenbaugh on Mar. 16, 1993, and U.S. Pat. No. 5,431,461, issued to Edward W. Andersen, III et al. on Jul. 11, 1995.

U.S. Pat. No. 3,591,222 to Schaber et al. discloses a support or holder for a cover or lid of furniture. It comprises a sliding bar pivoted at one end to the cover or lid, and a guide connected to the body of the furniture and having a through cavity in which the sliding bar is mounted.

U.S. Pat. No. 4,073,522 to Tierney discloses a security step or stop for a slidable door. The unit consists of a pair of bars pivotally linked together at adjoining ends and of a length to fit in the extended position, between an external bottom side edge of a slidable door and the bottom side edge of the door frame within the bottom channel in which the door slides to block movement of the door in the closed door position.

U.S. Pat. No. 4,461,502 to Burgess discloses an adjustable bar lock. It includes a telescopically adjustable bar comprising first and second rigid links threadably interconnected. The first link is pivotally connected to a base adapted for mounting on an abutment member in a sliding door or window assembly. The second link includes a free end adapted for engaging a slidable member of the door or window assembly when the bar is in a locked position, whereby the slidable member is maintained in a closed location.

U.S. Pat. No. 4,570,095 to Waldo et al. discloses a locking apparatus for use with a panel slidable in a plane. The locking apparatus comprises two slidably attached members and a locking mechanism which prevents movement, in one direction only, of one of the two members relative to the other member.

U.S. Pat. No. 5,193,865 to Allenbaugh discloses a sliding door bar lock. The device comprises a locking assembly mounted on a sliding door for movement between a locked position and an unlocked position. An elongated bar has one end pivotally connected to a door frame and a free end has a specially shaped recess adapted to engage with and disengage from the locking assembly.

U.S. Pat. No. 5,431,461 to Andersen, III et al. discloses a sliding window lock for automotive vehicles. It comprises a bar having a first end, which is engageable with a window, and a second end. In a first configuration, where both windows can slide, the second end is engageable with the second window. In a second configuration, where only one window can slide, the second end is engageable with a part of the vehicle, specifically, a window guide.

The present invention is completely different than these patents in-that it consists of a security device for a sliding door and window assembly having a-sliding panel in a frame. The device consists of a bar pivotally attached at a first end to an inner side edge of the panel. The bar has a fixed pin secured longitudinally at a second end. The bar can pivot down one hundred and eighty degrees from an upright storage position to a downward locked position allowing the fixed pin to engage with one of a plurality of spaced apart holes in a bottom track of the frame, thereby preventing the panel from being opened.

None of the above inventions and patents, taken either singly or in combination, is seen to describe the instant invention as claimed.

SUMMARY OF THE INVENTION

The present invention is a security device for a sliding door or window assembly having a sliding panel in a frame that consists of a bar pivotally attached at a first end to an inner side of the sliding panel, with the bar having a fixed pin secured longitudinally at a second end, so that the bar can pivot down one hundred and eighty degrees from an upright storage position to a downward locked position, allowing the fixed pin to engage with one of a plurality of spaced apart holes in a bottom track of the frame, thereby preventing,the panel from being opened.

Accordingly, it is a principal object of the invention to provide a security device for a sliding door or window assembly that will overcome the shortcomings of the prior art devices.

Another object of the invention is to provide a security device for a sliding door or window assembly having a bar pivotally attached to an inner side of a sliding door or window panel and is rotated one hundred and eighty degrees to be secured to a bottom track using a fixed pin.

An additional object of the invention is to provide a security device for a sliding door or window assembly that can be used to lock the sliding door or window panel in a closed position in the frame or in a slightly open position for ventilation.

A further object of the invention is to provide a security device for a sliding door or window assembly that is simple and easy to use.

A still further object of the invention is to provide a security device for a sliding door or window assembly that is economical to manufacture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
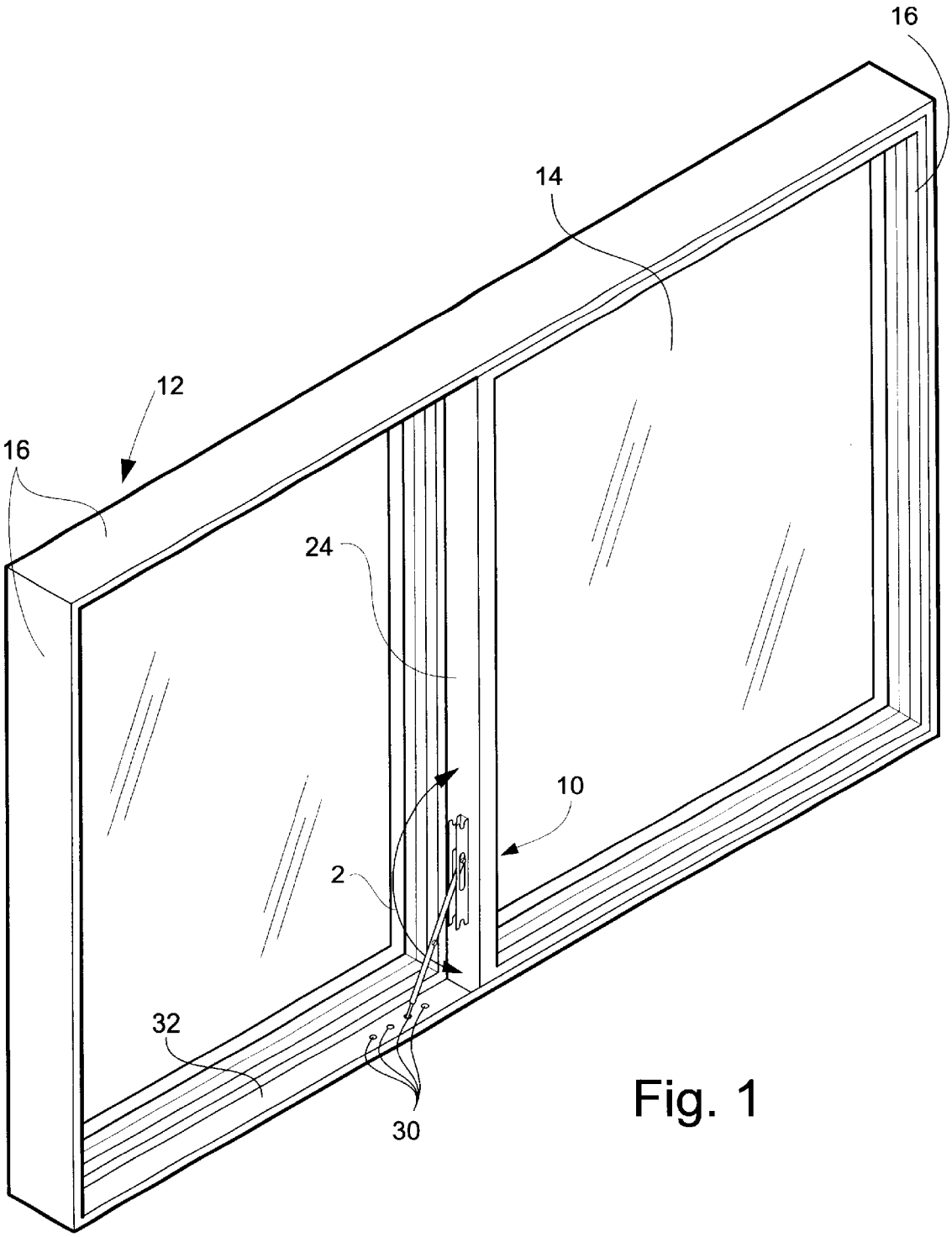
FIG. 1 is a diagrammatic perspective view showing the present invention being used in a sliding door or window assembly.
Figure 2:
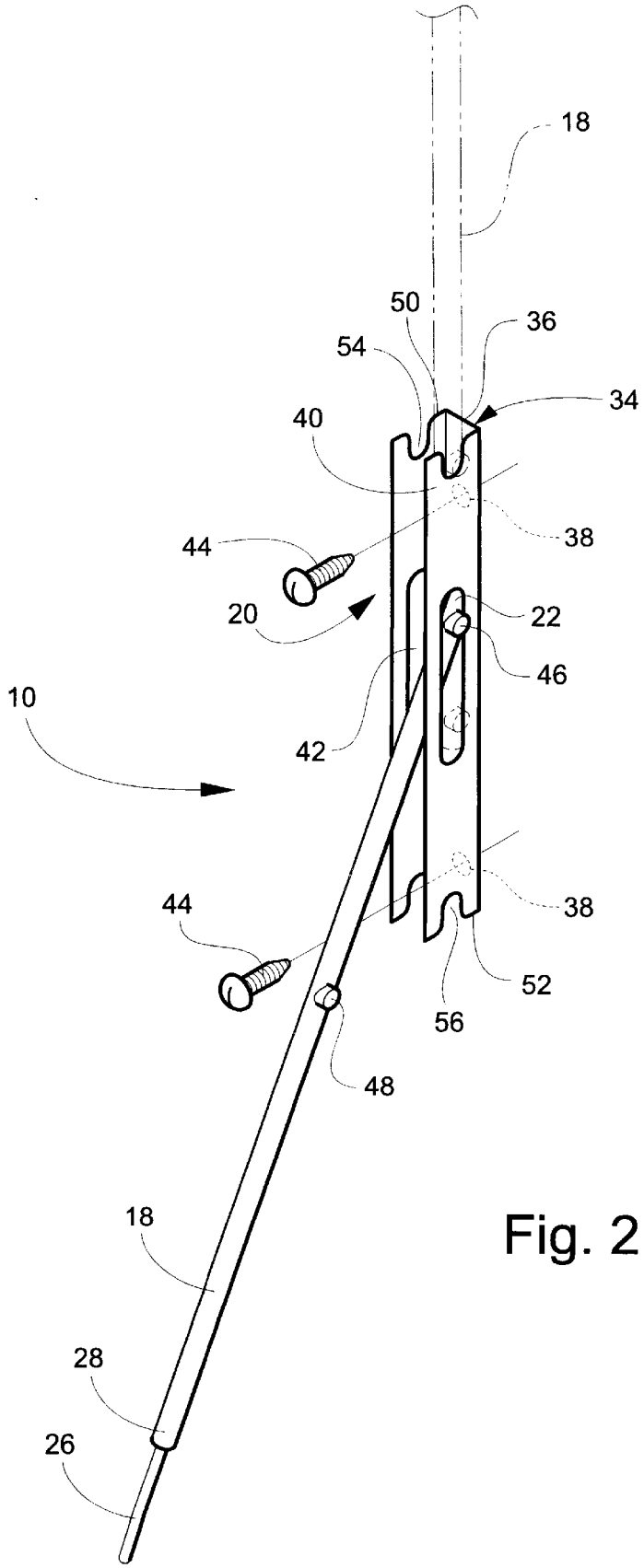
FIG. 2 is a detailed side view of the present invention.

Turning now descriptively to the drawings, in which similar reference characters denote similar elements throughout the several views, FIGS. 1 and 2 illustrate the various components of the present invention being a security device 10 for a sliding door or window assembly 12 having a sliding panel 14 in a frame 16. The device 10 comprises a bar 18. A structure 20 is for pivotally attaching a first end 22 of bar 18 to an inner side edge 24 of panel 14. A fixed pin 26 is secured longitudinally to a second end 28 of bar 18. Bar 18 may pivot up to one hundred and eighty degrees from an upright storage position to a downward locked position as indicated at 2, allowing fixed pin 26 to engage with one of a plurality of spaced apart holes 30 in a bottom track 32 of frame 16, thereby preventing panel 14 from being opened.

Pivotally attaching structure 20 includes a U-shaped bracket 34 comprising a mounting surface 36 having two spaced apart fastener apertures 38 and two substantially parallel spaced plates 40 connected to mounting surface 36, with plates 40 each having a vertical pivot slot 42. A pair of self-tapping screws 44 are provided, to extend through fastener apertures 38 in mounting surface 36 and into inner side edge 24 of panel 14. A shaft 46 extends transversely through first end 22 of bar 18 to ride and pivot within vertical pivot slots 42 in plates 40.

A locking pin 48 extends transversely through and approximately one third the distance from first end 22 of bar 18. Security device 10 further includes a first configuration 50 in U-shaped bracket 34, for holding bar 18 in the upright storage position. A second configuration 52 in U-shaped bracket 34 holds bar 18 in the downward locked position.

The first holding configuration 50 includes plates 40 of U-shaped bracket 34, each having a top locking notch 54 to retain locking pin 48 when bar 18 is pivoted upward into the upright storage position. Second holding configuration 52 includes plates 40 of U-shaped bracket 34, each having a bottom locking notch 56, to retain locking pin 48 when bar 18 is pivoted downward into the downward locked position.

U-shaped bracket 34 is mounted at a proper height to inner side edge 34 of panel 14 with self-tapping screws 44. Fixed pin 26 can now enter one of the holes 30 in bottom track 32 of frame 16 when bar 18 is pivoted downward and locking pin 48 engages bottom locking notches 56 in the downward locked position. When bar 18 is not being used locking pin 48 is released from locking notches 56 and fixed pin 26 removed from hole 30. Bar 18 is pivoted one hundred and eighty degrees upward. Locking pin 48 now engages top locking notches 54 in the upright storage position. Device 10 can be used to lock sliding panel 14 in a closed position or in a slightly opened position for ventilation.

It is to be understood that the present invention is not limited to the embodiments described above, but encompasses any and all embodiments within the scope of the following claims.

I claim:

1. A security device for a sliding door or window assembly having a sliding panel in a frame, said device comprising:

a bar;

means for pivotally attaching a first end of said bar to an inner side edge of said panel; and a fixed pin secured longitudinally to a second end of said bar, so that said bar can pivot down one hundred and eighty degrees from an upright storage position to a downward locked position, allowing said fixed pin to engage with one of a plurality of spaced apart holes in a bottom track of said frame, thereby preventing said panel from being opened, wherein said pivotally attaching means includes:

a U-shaped bracket comprising a mounting surface having two spaced apart fastener apertures and two substantially parallel spaced plates connected to said mounting surface, with said plates each having a vertical pivot slot;

a pair of self tapping screws, to extend through said fastener apertures in said mounting surface and into said inner side edge of said panel; and a shaft extending transversely through said first end of said bar to ride and pivot within said vertical pivot slots in said plates, further including a locking pin extending transversely through and approximately one third the distance from said first end of said bar, further including:

first holding means in said U-shaped bracket, for holding said bar in the upright storage position; and second holding means in said U-shaped bracket, for holding said bar in the downward locked position, wherein said first holding means includes said plates of said U-shaped bracket, each having a top locking notch to retain said locking pin when said bar is pivoted upward into the upright storage position.

2. A security device for a sliding door or window assembly having a sliding panel in a frame, said device comprising:

a bar;

means for pivotally attaching a first end of said bar to an inner side edge of said panel; and a fixed pin secured longitudinally to a second end of said bar, so that said bar can pivot down one hundred and eighty degrees from an upright storage position to a downward locked position, allowing said fixed pin to engage with one of a plurality of spaced apart holes in a bottom track of said frame, thereby preventing said panel from being opened, wherein said pivotally attaching means includes:

a U-shaped bracket comprising a mounting surface having two spaced apart fastener apertures and-two substantially parallel spaced plates connected to said mounting surface, with said plates each having a vertical pivot slot;

a pair of self tapping screws, to extend through said fastener apertures in said mounting surface and into said inner side edge of said panel; and a shaft extending transversely through said first end of said bar to ride and pivot within said vertical pivot slots in said plates, further including a locking pin extending transversely through and approximately one third the distance from said first end of said bar, further including:

first holding means in said U-shaped bracket, for holding said bar in the upright storage position; and second holding means in said U-shaped bracket, for holding said bar in the downward locked position, wherein said second holding means includes said plates of said U-shaped bracket each having a bottom locking notch to retain said locking pin when said bar is pivoted downward into the downward locked position.

* * * * *